US005417488A

United States Patent [19]

Horton

[11] Patent Number: 5,417,488

[45] Date of Patent: May 23, 1995

[54] MECHANICAL SECURITY APPARATUS FOR FACSIMILE MACHINES

[76] Inventor: Harry M. Horton, 3149 Princess Blvd., Burlington, Ontario, Canada, L7N 1G5

[21] Appl. No.: 91,570

[22] Filed: Jul. 15, 1993

Related U.S. Application Data

[63] Continuation-in-part of Ser. No. 729,637, Jul. 15, 1991, abandoned.

[51] Int. Cl.[6] ..... A47B 21/00

[52] U.S. Cl. ..... 312/208.3; 400/690

[58] Field of Search ..... 312/208.3, 208.2, 208.1, 312/244, 290, 284, 283; 400/690, 691, 690.4, 693, 694

[56] References Cited

U.S. PATENT DOCUMENTS

| | | | |
|---|---|---|---|
| 4,626,048 | 12/1986 | Goodlander | 312/208 |
| 4,645,275 | 2/1987 | Pucci | 312/244 |
| 4,726,699 | 2/1988 | Buschmann et al. | 312/208 |
| 4,755,010 | 7/1988 | Wilson et al. | 312/208 |

FOREIGN PATENT DOCUMENTS

| | | | |
|---|---|---|---|
| 0238802 | 9/1987 | European Pat. Off. | 312/208 |

*Primary Examiner*—James R. Brittain
*Assistant Examiner*—Gerald A. Anderson

[57] ABSTRACT

An apparatus is provided to secure a facsimile machine and provide a secure receptacle portion adapted to receive and retain paper output from facsimile machines, so as to ensure the security and confidentiality of paper output from facsimile machines, so that the paper output is not accessed or read except by persons authorized to do so. The apparatus accommodates the usual operating function of a facsimile machine such as inputting paper having written messages to be sent elsewhere and receiving the paper output of messages received from elsewhere. A base portion supports the facsimile machine on a horizontal surface and secures it thereto. A cover portion generally covers the facsimile machine and precludes it from being removed from the base portion. The receptacle portion and the cover portion are moveable with respect to each other so as to provide selectively securable access to the interior of the receptacle, being limited only to those who have a key or other means to open the receptacle. The cover for the entire apparatus also serves to secure the facsimile machine against unwanted or unwarranted removal away from its position.

9 Claims, 4 Drawing Sheets

MECHANICAL SECURITY APPARATUS FOR FACSIMILE MACHINES

CROSS REFERENCE

This application is a Continuation-In-Part of application Ser. No. 07/729,637 filed Jul. 15, 1991, now abandoned.

FIELD OF THE INVENTION

This invention relates to security devices and more particularly to security devices for facsimile machines. A security device for securing paper output from facsimile machines is discussed.

BACKGROUND OF THE INVENTION:

A very necessary and integral part of everyday business, no matter what type of business it may be, is sending and receiving information. Generally, information is passed along in one of a few ways. Information may be passed along verbally, very often via telephone lines. Information may also be passed along electronically via computers with modems, or in a similar manner.

If information is passed along in a conversation, there is no record of the information unless notes are taken. If the information is passed between computers, then a record copy of the information may be produced for example either on a hard disk or on paper.

Another common form of sending and receiving information is on a printed page, which ensures that there is a written record of the information being transmitted. Much of the information sent by printed page is sent by postal services, which generally provide fairly inexpensive and reasonably expedient service. Regular mail service may take a few days while a special delivery type of service may take only one day—or even less—to deliver printed information, such as a letter or the like. An increased speed of postal service has associated with it a correspondingly increased cost, however.

In any case, mail delivery is not immediate, and most likely is not even to occur on the same day that it is sent. It is possible, however, to have more expedient delivery of packages by other similar means such as a courier service. Such courier services are generally more expensive and still take at least several hours, if not most of the day or even a full day, to deliver printed material. In some cases, this is an unacceptable time between the time that printed information is sent and the time that it is received. The time between sending and receiving is obviously increased if the origin and the destination of the printed matter are a great distance apart—and it is quite common to have the origin and destination several thousand miles apart.

One advantage to some forms of mail or courier delivery service is that a very secure type of delivery service is available—at an increased cost—in that the printed matter being sent is virtually guaranteed to arrive safely at its destination. Such a secure type of delivery usually involves written registration of the printed material so that it may be tracked from its origin, along its route and to its destination. For some information, it is quite important that such a secure means of delivery be employed.

In any event, printed material is almost always sent in a protective cover—such as an envelope—to protect the printed material from damage and also to help maintain the confidentiality of the information contained in the printed material.

In the past few years, another means for transmitting information that results in a printed copy of the information at the destination has been developed and made readily available to businesses. Such a means is the facsimile machine, or fax. A facsimile machine, in its most common form, scans a paper document and develops an electronic representation of the document. This electronic representation is turned into an electronic signal, and is then transmitted over telephone lines from a sending facsimile machine to a receiving facsimile machine. The receiving facsimile machine receives the electronically transmitted signal and decodes it back into an electronic representation of the paper document. It then reproduces a copy of the original document.

Unfortunately, a facsimile paper output from a receiving machine must first be read, or at least in part, so that it can be determined who the facsimile is for. Moreover, the confidentiality and security afforded to printed matter by envelopes, which are universally used in sending printed matter by mail or courier or the like, is not afforded to the output from facsimile machines. Thus, there is a lack of security associated with sending documents via facsimile machines because anyone at a receiving facsimile machine may read the facsimile paper output being printed by a receiving facsimile machine. Even if a cover page is used with a facsimile machine transmission, this only identifies who the printed facsimile paper output is addressed to, but does not preclude anyone else from having access to the facsimile paper output.

In order to provide some sort of security in terms of precluding any persons from reading a printed facsimile paper output who is not authorized to do so, it may be necessary to lock the facsimile machine away in a closet or room. This is generally completely unacceptable and only works if the closet or room is locked or guarded. Alternatively, it is possible to have someone watch over the facsimile machine and to distribute the received facsimiles to the appropriate person. This is undesirable since it is poor use of a person's time. It is also possible to have the person who is receiving the facsimile watch the output from the facsimile machine. This is also generally unacceptable since very often the person to whom the facsimile printed output is directed cannot watch over the machine. Indeed, it can be envisioned that several people could be standing at a facsimile machine at any given time, each waiting for a confidential facsimile to be received.

It has been observed, however, that people who are expecting to receive a facsimile of a sensitive or confidential nature will huddle over a receiving facsimile machine until the facsimile paper output has been printed. Very often, this may be the president of a company whose time is indeed very valuable and which should not be spent in such a manner. Obviously, for people to act in such manner, the problem of having other persons read facsimile paper output transmissions is considered a very definite problem and a very definite risk.

In order to gain some measure of security, many people send and receive facsimiles during off-hours—when the person receiving the facsimile is generally the only one present. This does not always work, however, and facsimiles sent during off-hours may remain at the facsimile machine until the person who is to receive the facsimile actually collects it. In this case, there is no measure of security.

Indeed, it is believed that it is becoming an ever increasing occurrence in business for some people to arrive at the office early in order to go through any facsimiles received during the night, thus creating a definite security risk.

Typically, confidential or sensitive material contained in printed paper documents are still sent by mail or courier and are not sent by facsimile, for the reason of lack of security.

DESCRIPTION OF THE PRIOR ART:

U.S. Pat. 4,626,048 to GOODLANDER discloses a computer printer housing that is a full size floor-standing unit capable of housing at least one printer therein. This unit cannot be used on a desk, table, or stand. In one embodiment, the printer is on a slidable shelf so as to be temporarily removable from the interior of the enclosure. The printer housing is further adapted to separately house a box of computer paper and also the paper output from the printer. Due to the large open-style structure of the printer housing, as soon as access is gained to the printer in order to operate it, then complete and total access is gained to the printer which would allow someone to remove the printer. In other words, the printer is not secured while allowing for operational access to it. Further, there is no specific receptacle portion adapted to receive paper output from the printer that completely precludes access to that paper output. Although the paper output may ultimately end up in an area within the printer housing that is locked, even when the printer is accessible, the paper output is still accessible as it exits the printer, before it reaches this secured area. Basically, if the printer is accessible, then the paper output from the printer is accessible. In accordance with the printer housing taught in this patent, as soon as any sort of access is gained to the printer, which would occur any time the doors of the cabinet are not locked, then there is complete access to the printer and to the output therefrom, and either the printer or the output therefrom could be readily removed. The same would of course hold true for a facsimile machine contained therein. This device is not a security device whatsoever.

U.S. Pat. 4,645,275 to PUCCI discloses a portable carrying case and sound shield for a printer wherein a printer is contained within this device such that access to the controls is precluded and the paper output exits directly out of the case. This device is a carrying case and a sound shield for a printer, and not a security device.

There is no known prior art that directly and properly addresses the problem of the security of facsimile machines and the printed output therefrom.

Often, if documents of a sensitive or confidential nature are being received, there will be a facsimile attendant assigned to immediately distribute the printed facsimile output. Unfortunately, this provides the opportunity for the attendant to read the output. Further, an attendant may not necessarily be at the facsimile machine at all times.

Another known solution to the problem is to lock the facsimile machine in a closet or room, but this provides minimal security at best—or at least very inconvenient security.

An alternative solution to protecting or securing the actual printed output from a facsimile machine is to store the electronic facsimile signal as an electronic representation of the facsimile message, until the person for whom the facsimile is intended wishes the facsimile to be printed. There are a number of known ways to facilitate storage and retrieval of electronic facsimile representations, each of which stores the electronic facsimile representation as computer data.

One way is to store the electronic representation at a remote location in a facsimile network system. Such a system typically utilizes a mainframe computer system to store the electronic representation as computer data and to control access to the data. In order to retrieve the data and have it print out as a facsimile, the facsimile network system is accessed by the person for whom the facsimile is intended. It is necessary that this person enter a security code to have the data retransmitted as an electronic facsimile representation to a facsimile machine.

Another way of obtaining a measure of security is to store the electronic representation at the location of the receiving facsimile machine on a dedicated microcomputer. Such a microcomputer could store the data in memory (RAM) or even on a hard disk. The data could be released by the person for whom the facsimile is intended by entry of a security code. The facsimile is then printed by the facsimile machine.

It is also possible to have a facsimile machine with built-in information storage capabilities wherein an incoming facsimile is stored in the memory (RAM) of the facsimile machine and is later released. Such release could require that a security number be entered.

A disadvantage of such types of electronic facsimile storage systems is that the information can be retrieved by anyone with access to the security code required to release the facsimile. Further, if the electronic information is for some reason destroyed the facsimile is irretrievably lost. Additionally, there is no guarantee of absolute security of the data stored at a remote location.

Further, it is also common to use a chain or cable in conjunction with a lock mechanism to secure a facsimile machine to a desk or table. This form of securing provides no security for the paper output from the facsimile machine whatsoever.

SUMMARY OF THE INVENTION

In accordance with the present invention, there is provided a securing apparatus for use in conjunction with a facsimile machine, to secure the facsimile machine and provide a secure receptacle adapted to receive and retain paper output from the facsimile machine. The facsimile machine has a paper accepting slot adapted to accept sheets of paper fed into the facsimile machine and has operational controls thereon, and has means to eject paper output from a paper output slot. The apparatus comprises a base portion adapted for placement on a generally horizontally disposed surface, whereby the facsimile machine is supported by the base portion is juxtaposed relation to the generally horizontal surface. A cover portion is attached to the base portion so as to cover the facsimile machine and provide a hollow cavity therewithin adapted to receive and retain the facsimile machine. The facsimile machine is thereby secured so as to preclude unwanted removal from the securing apparatus while access is permitted to the paper accepting slot and the operational controls. The cover is preferably selectively openable to permit access to the facsimile machine. The receptacle of the apparatus may be oriented either vertically or horizontally. A receptacle portion is operatively attached to and extends from the base portion and the cover portion. The receptacle portion defines a hollow interior that is substantially enclosed and is thereby adapted to receive and securely retain therein paper output from the facsimile machine. The receptacle portion further defines an inlet to the hollow interior of the receptacle portion, with the inlet portion being adapted to receive paper output from the facsimile machine into the hollow interior of the receptacle portion. At least a portion of either of the receptacle portion and the cover portion forms a movable member that is selectively movable with respect to the other of the receptacle portion and the cover portion, between a first closed position and a second opened position so as to permit access to the hollow interior of the receptacle portion when the movable member is in its second opened position and to preclude access to the hollow interior of the receptacle portion when the movable member is in its first closed position. A blocking portion of at least one of the receptacle portion and the cover portion generally surrounds the paper output slot of the facsimile machine so as to thereby preclude access to the paper output being ejected from the paper output slot so that the paper output is fed directly into the receptacle portion, at least when the movable member is in the closed position.

Each of these configuration is useful depending on where a facsimile machine is to be located and as to the type of surface it is located on. The receptacle may also be adjustable from a horizontal orientation to a vertical orientation.

It is also possible have the access to the receptacle as a separate door or the like so that access may gained to the receptacle without moving the cover away from facsimile machine. Alternatively, the receptacle itself may be movable with respect to the rest of the apparatus in order to gain access to any paper output in the receptacle.

In use, if the facsimile machine paper output does not need to be secured, the apparatus can be left in an unsecured or open state—that is to say the cover or the door or whatever may be left such that access maybe gained to the paper output at any time. When it is desired that the apparatus be secured such that access to any facsimile paper output is precluded the cover, receptacle, or whatever is merely moved to the secured position and preferably locked.

BRIEF DESCRIPTION OF THE DRAWINGS

Embodiments of this invention will now, be described by way of example in association with the accompanying drawings in which.

Figure 1:
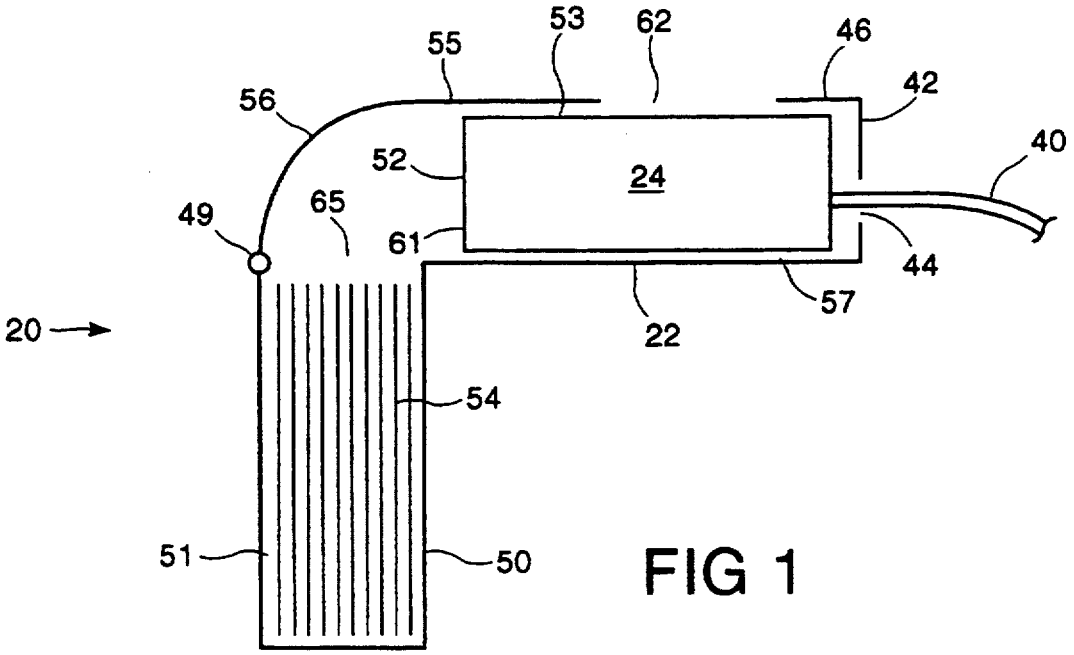
FIG. 1 is a sectional side view of the apparatus of the present invention containing a facsimile machine.
Figure 2:
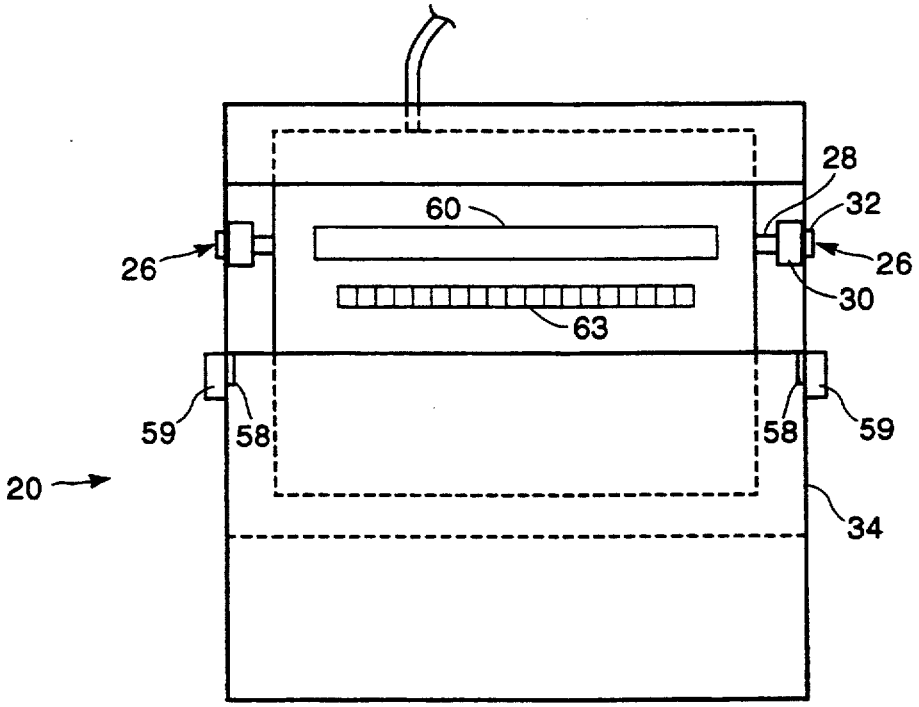
FIG. 2 is a view of the apparatus of the present invention containing a facsimile machine therein with portions of the facsimile machine and apparatus showing in ghost outline.
Figure 3:
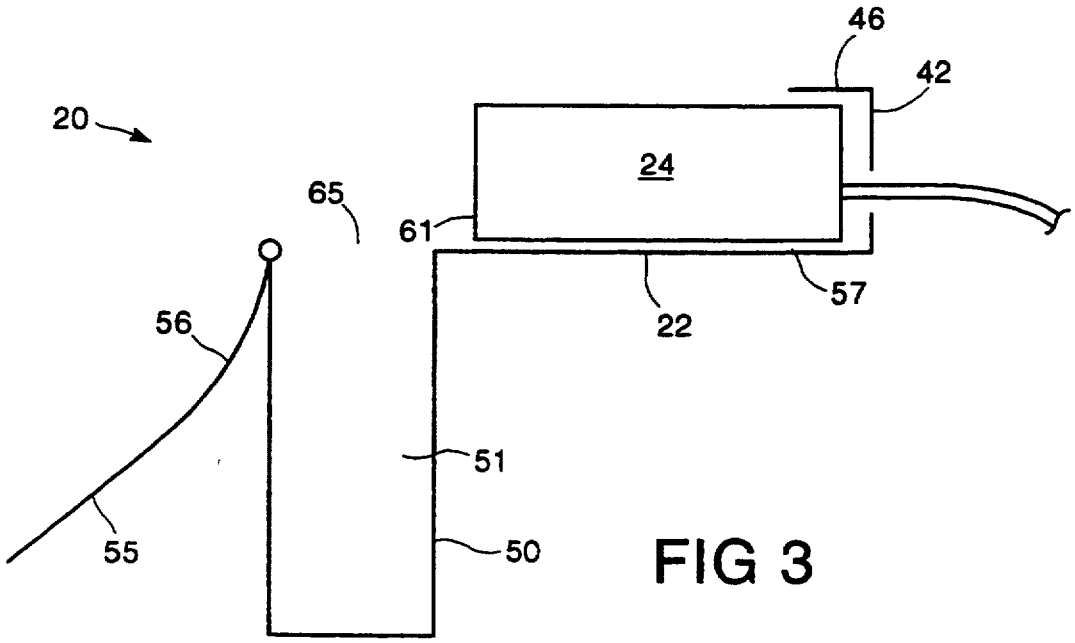
FIG. 3 is a view similar to FIG. 1 with the apparatus in an open unsecured state.

DETAILED DESCRIPTION OF THE PREFERRED EMBODIMENTS:

Reference will now be made to FIGS. 1 to 3 which show the apparatus 20 of the present invention in its secured state and in its unsecured state. The facsimile machine 24 has a paper accepting slot 60 in the top thereof, which paper accepting slot 60 is adapted to accept sheets of paper fed into the facsimile machine 24. The paper accepting slot 60 is used to accept paper containing printed information to be transmitted by the facsimile machine 24. There is an opening 62 in the apparatus 20 between the cover portion 56 and the rear top panel 46 that allows for access to the paper accepting slot 60. Inclusion of this opening 62 allows facsimiles to be transmitted even when the apparatus 20 is in its security state—with the cover portion 56 in its closed position. Once a piece of paper is entered into the paper accepting slot 60, it exits the facsimile machine 24 through a paper output slot 61 at the front end 52 of the facsimile machine and is received and retained by the receptacle portion 50. There are also operational controls 63 located on the facsimile machine, which operational controls 63 are accessible through the opening 62.

The apparatus 20 has a base portion 22 that is adapted for placement on a generally horizontally disposed surface. The facsimile machine 24 is supported by the base portion 22 in juxtaposed relation to the generally horizontal surface. The facsimile machine 24 may be secured to the apparatus 20 by a pair of holding mechanisms 26. The holding mechanisms 26 comprise a contacting portion 28, a body portion 30 and an adjusting portion 32. The body portion 30 is held securely within the side panels 34 of the apparatus 20. The contacting portion 20 of the holding mechanism 26 is movably engaged within the body portion 30 and is adapted to be in intimate contact with the facsimile machine 24 without damaging it. Preferably, there is a soft material on the end of the contacting portion 28 to preclude damage to the facsimile machine 24. In order to adjust the position of the contacting portion 28 the adjusting portion 32, which is located at the exterior of the apparatus 20, is turned or adjusted in some manner. Adjusting each of the adjusting portions 32, one being on each of the holding mechanisms 26, will move each contacting portion 28 into intimate contact with the facsimile machine thereby retaining it within the apparatus 20.

Other types of locking mechanisms may also be used to secure the facsimile machine 24 to the apparatus 20, or indeed the facsimile machine 24 may just sit freely within the apparatus 20.

Cables and cords 40, which normally interface with a facsimile machine at the rear thereof, exit through the rear panel 42 of the apparatus 20 through rear access opening 44. The rear panel 42 precludes the facsimile machine from being generally accessible from the rear or from being removed through the rear of the apparatus 20. The rear top panel 46 of the apparatus 20 precludes the facsimile machine 24 from being removed therefrom in an upward direction.

In order to preclude access to the facsimile paper output that exits the facsimile machine 24 at the front end 52 thereof, and to preclude unwanted removal of the facsimile machine 24 from the securing apparatus 20, there is a cover portion 56. A cover portion 56 is attached to the base portion 22 in overlying relation thereto so as to create a hollow cavity 57 that is adapted to receive and retain the facsimile machine 24 therein.

The cover portion 56 allows access to the paper accepting slot 60 and the operational controls 63 so that the facsimile machine 24 may be used to send facsimiles and may be operated in general. The apparatus 20 also comprises a receptacle portion 50 that defines a hollow interior 51 that is substantially enclosed and is thereby adapted to receive and retain therein facsimile paper output from the facsimile machine 24. The hollow interior 51 is physically separated from the hollow cavity 57. The receptacle portion 50 is located at the front end 52 of the facsimile machine 24, as this is where the facsimile paper output is produced. The receptacle portion 50 is operatively attached to and extends outwardly from the base portion 22 and the cover portion 56. In the preferred embodiment, the receptacle portion 50 projects substantially vertically downwardly in order that the facsimile paper output 54 can fall into it and also so that it does not extend outwardly any more than necessary since many facsimile machines are designed such that the front end 52 thereof is to be located at the edge of a table or desk. The receptacle portion 50 further defines an inlet 65 that is adapted to receive paper output from the facsimile machine 24 and allow it to pass into the hollow interior 51 of the receptacle portion 50. When the cover portion 56 is in its first closed position as shown in FIG. 1, the apparatus 20 is in a secured state. In this secured state, access to the hollow interior 54 of the receptacle portion 50 is precluded. Further, a blocking portion 55 of the cover portion 56 and a block portion 49 of the receptacle portion 50 generally surround the paper output slot 61 so as to thereby preclude access to the paper output being ejected from the paper output slot 61. In this manner, the paper output must be fed directly into the hollow interior 51 of the receptacle portion 50, when the cover 56 is in its closed position. In this first closed position, it is necessary that the cover portion 56 either generally contact the facsimile machine 24 or at least extend to very near the facsimile machine 24 in order to preclude access to the area around the front end 52 and into the receptacle portion 50. The cover portion 56 is preferably hinged to the receptacle portion 50 so that it may be easily moved out of the way to an opened position such that there is ready access to the front end 52 of the facsimile machine 24 and to any facsimile paper outputs 54 in the receptacle portion 50 by a duly authorized person. The apparatus 20 is shown in its open state in FIG. 3. When the cover portion 56 is in its second opened position, the apparatus 24 is in an unsecured state. In this unsecured state, there is complete access to the facsimile machine 24.

The cover portion 56 preferably latches to each of the side panels 34 of the apparatus 20 and further is locked in place by locks 58. The locks 58 are preferably key operated for simplicity and ease of use and also to preclude any unauthorized or unwanted access to the facsimile machine 24 and the facsimile paper output 54 therefrom.

Alternatively, the cover portion 56 may have a hinge 49 that is lockable such that the cover 50 can be set at and locked into any orientation. This will allow the cover portion 56 to be secured without having to be locked at lock 58. In this manner, if the facsimile machine 24 is higher than the side panel 34 it can be secured as far as access to the front end 52 and facsimile paper output 54 and the receptacle portion 50.

Another consideration is the adjustability of the cover portion 56. It is important that the cover portion 56 not block the top front portion 53 of the facsimile machine 24 because typically this is where many of the controls of the facsimile machine are. The size or positioning of the cover portion 56 may be adjustable in order to accomplish this.

It is preferable that the apparatus 20, especially the cover portion 56 and the receptacle portion 50, be of a generally opaque material, so that the facsimile paper output 54 cannot be read while it is in the receptacle portion 50.

Figure 4:
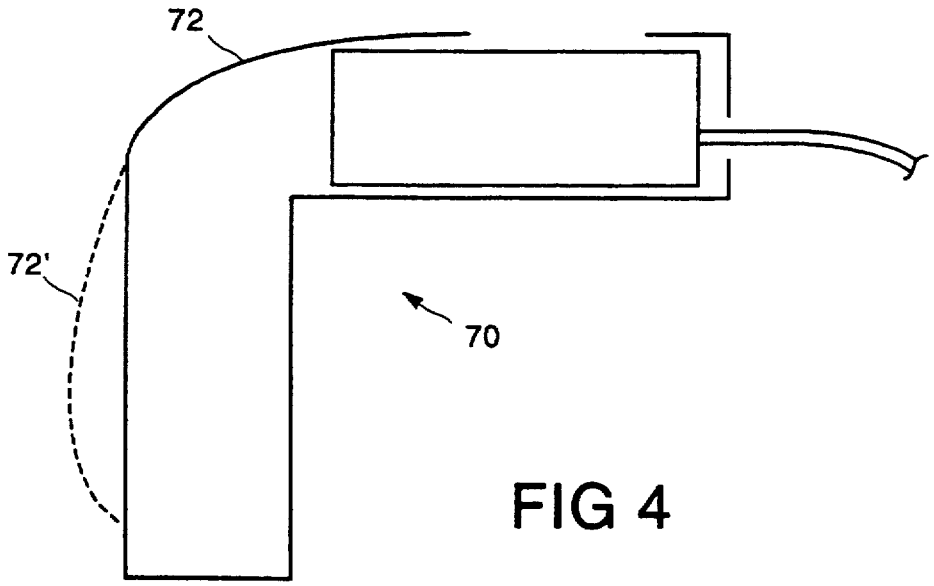
FIG. 4 is an alternative embodiment of the present invention.

FIG. 4 shows an alternative embodiment that is generally similar to the preferred embodiment shown in FIGS. 1 through 3, except that the apparatus 70 has a cover 72 that slides upwardly and downwardly instead of being move rotatably on a hinge. The cover 72 is shown by a solid line in its closed position and in ghost outline in its second opened position (72').

Figure 5:
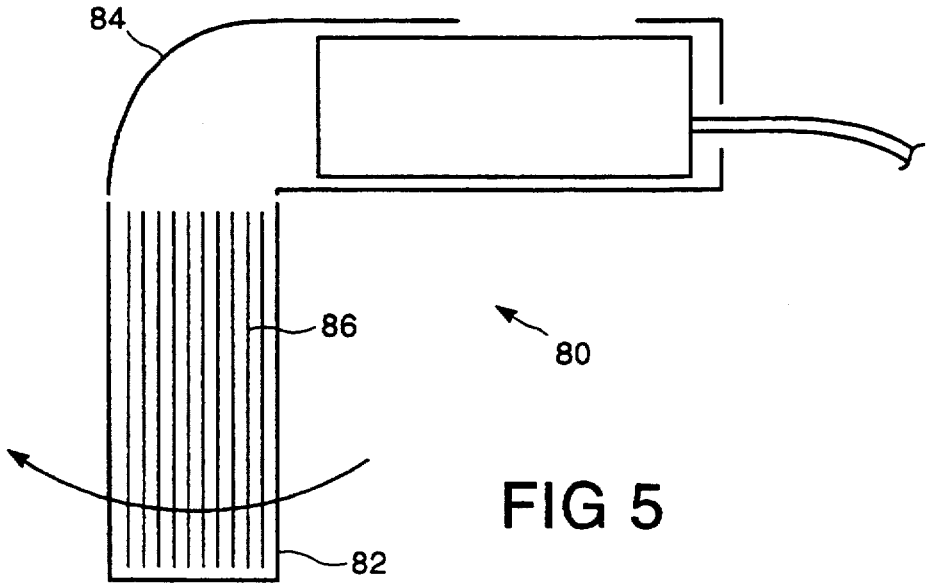
FIG. 5 is another alternative embodiment of the invention.

The alternative embodiment shown in FIG. 5 shows an apparatus 80 having a receptacle portion 82 that is pivotally attached to the cover 84 for movement between a first closed position and a second opened position, such that a portion of the receptacle portion 82 pivots outwardly thus allowing access to any facsimile paper output 86 within the receptacle portion 82.

Figure 6:
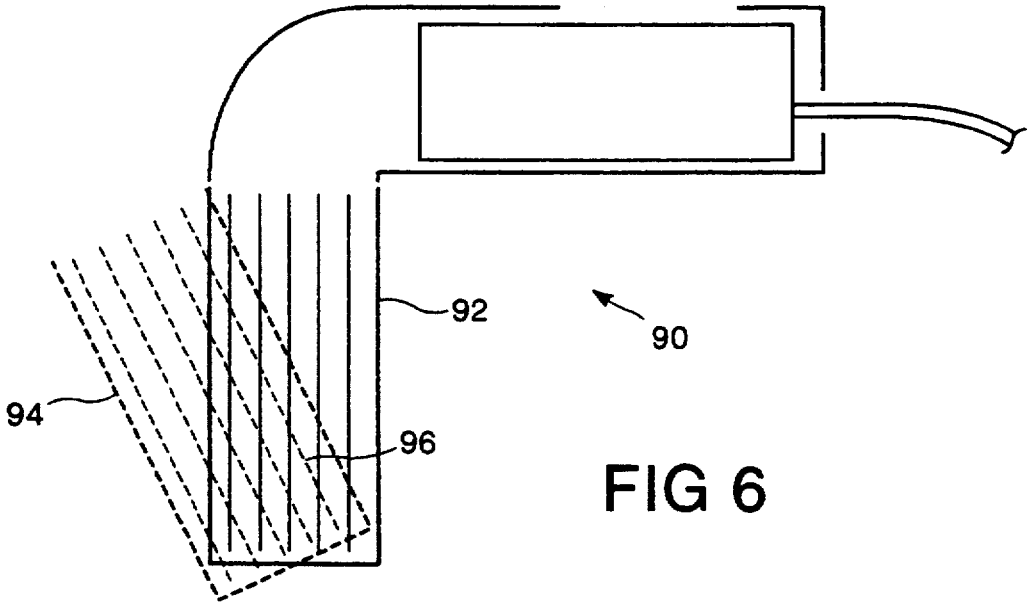
FIG. 6 shows yet another alternative embodiment of the invention.

FIG. 6 shows an alternative embodiment that is somewhat similar to the alternative embodiment shown in FIG. 5 in that there is an apparatus 90 having a receptacle portion 92 with a moveable portion 94 (shown in ghost outline) that pivots such that the top portion thereof moves forwardly to allow access to the facsimile paper output 96 contained therein.

Figure 7:
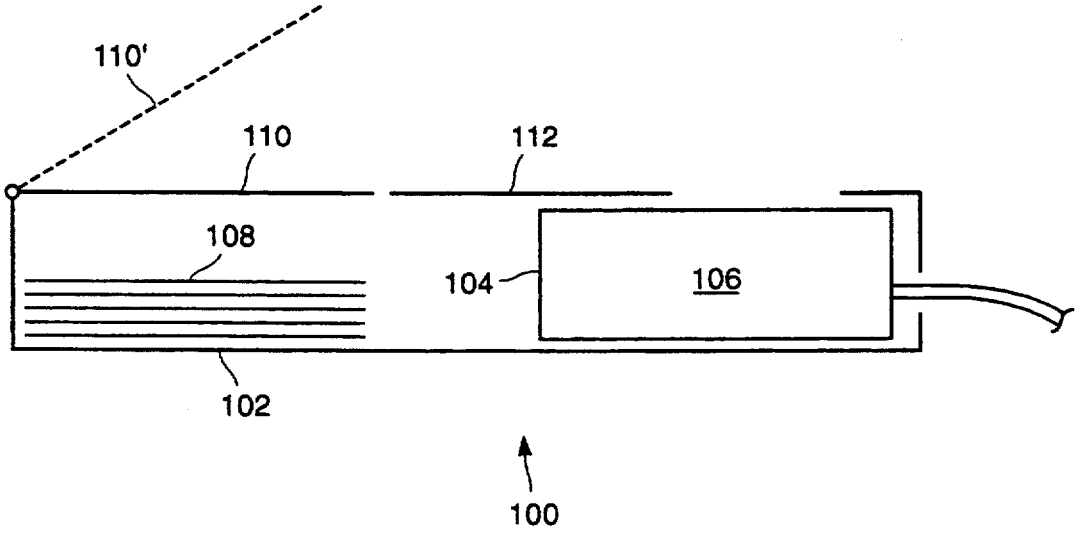
FIG. 7 shows a further alternative embodiment of the invention.

FIG. 7 shows an alternative embodiment wherein the apparatus 100 has a receptacle portion 102 that projects substantially horizontally outwardly. This configuration of apparatus would typically be used on a table or desk where the front end 104 of the facsimile machine 106 is not near the edge of the table or desk. Access to the facsimile paper output 108 in the receptacle portion 102 is gained by moving the first cover 110 to an open position as shown in ghost outline at 110. A second cover 112 may also be moveable to allow for access to the front area 114 of the facsimile machine 106.

In the embodiments shown in FIGS. 5, 6 and 7, a portion of the cover portion may also be movable separately from the receptacle portion, and also independently lockable.

In a further alternative embodiment, it is contemplated that the locks, as shown at 58 in FIG. 1, be controlled by a time release mechanism such that they are automatically locked and unlocked at given times during the day. It is, of course, important that if the locks are to lock automatically at a given time, the cover must be properly in place before the locking occurs.

It is also envisioned that the inlet into the hollow interior of the receptacle portion may be positioned in juxtaposed relation to the paper output slot of the facsimile machine.

Other modifications and alterations may be used in the design and manufacture of the mechanical security apparatus of the present invention without departing from the spirit and scope of the accompanying claims.

What is claimed is:

1. A securing apparatus securing a facsimile machine and provide a secure receptacle adapted to receive and retain paper output from said facsimile machine, wherein said facsimile machine has a paper accepting slot adapted to accept sheets of paper fed into said facsimile machine and has operational controls thereon, and has means to eject paper output from a paper output slot, said apparatus comprising:

a base portion adapted for placement on a generally horizontally disposed surface, whereby said facsimile machine is supported by said base portion in juxtaposed relation to said generally horizontal surface;

a cover portion attached to said base portion so as to enclose said facsimile machine whereby said facsimile machine is secured so as to preclude unwanted removal from said securing apparatus by openings in said cover portion providing access to said paper accepting slot and said operational controls; and a receptacle portion operatively attached to and extending from said base portion and said cover portion, said receptacle portion defining a hollow interior that is substantially enclosed by said receptacle portion and is thereby adapted to receive and securely retain therein paper output from said facsimile machine, said receptacle portion further defining an inlet to said hollow interior of said receptacle portion, with said inlet portion being adapted to receive paper output from said facsimile machine into said hollow interior of said receptacle portion;

wherein at least a access portion of either of said receptacle portion or said cover portion is a movable member that is selectively movable with respect to the other of said receptacle portion and said cover portion, between a closed position and a opened position so as to permit the only access to said hollow interior of said receptacle portion when said movable member is in said opened position and to preclude access to said hollow interior of said receptacle portion when said movable member is in said closed position; and wherein a blocking portion of said cover portion generally surrounds said paper output slot of said facsimile machine so as to thereby preclude access to said paper output being ejected from said paper output slot so that said paper output is fed directly into said receptacle portion, at least when said movable member is in said closed position.

2. The apparatus of claim 1, wherein said inlet to said hollow interior of said receptacle portion is positioned in juxtaposed relation to said paper output slot.

3. The apparatus of claim 1, wherein said movable member is a portion of said receptacle portion.

4. The apparatus of claim 1, wherein said movable member is a portion of said cover portion.

5. The apparatus of claim 3, wherein a machine portion of said cover portion is moveable to gain access to said facsimile machine.

6. The apparatus of claim 5, wherein said moveable member of said receptacle portion and said machine portion of said cover portion are separately moveable can be and independently locked.

7. The apparatus of claim 1, wherein said hollow interior of said receptacle portion is a extension of said hollow cavity.

8. The apparatus of claim 7, wherein said receptacle portion projects substantially downwardly.

9. The apparatus of claim 7, wherein said receptacle portion projects substantially horizontally outwardly.

* * * * *